US007007656B2

(12) United States Patent
Fujino

(10) Patent No.: US 7,007,656 B2
(45) Date of Patent: Mar. 7, 2006

(54) LUBRICATION SUPPLY CONTROL SYSTEM

(75) Inventor: Kenichi Fujino, Shizuoka (JP)

(73) Assignee: Yamaha Marine Kabushiki Kaisha, (JP)

( * ) Notice: Subject to any disclaimer, the term of this patent is extended or adjusted under 35 U.S.C. 154(b) by 0 days.

(21) Appl. No.: 10/701,904

(22) Filed: Nov. 5, 2003

(65) Prior Publication Data

US 2004/0089261 A1 May 13, 2004

(30) Foreign Application Priority Data

Nov. 5, 2002 (JP) ..... 2002-321470

(51) Int. Cl.
*F01M 1/00* (2006.01)

(52) U.S. Cl. ..... 123/196 R; 184/26; 123/73 AD

(58) Field of Classification Search ..... 123/196 R, 123/73 AD; 184/26
See application file for complete search history.

(56) References Cited

U.S. PATENT DOCUMENTS 4,403,578 A 9/1983 Iwai et al.
4,471,727 A 9/1984 Odashima
4,480,602 A 11/1984 Kobayashi et al.
4,572,120 A 2/1986 Matsumoto
4,637,355 A 1/1987 Odashima
4,638,771 A 1/1987 Mori
4,708,674 A 11/1987 Matsumoto
5,287,833 A 2/1994 Yashiro
5,355,851 A 10/1994 Kamiya
5,390,635 A 2/1995 Kidera et al.
5,537,959 A * 7/1996 Ito ..... 123/73 AD
5,597,051 A * 1/1997 Moriya et al. ..... 184/6.1
5,934,242 A * 8/1999 Anamoto ..... 123/196 R

* cited by examiner

*Primary Examiner*—Mahmoud Gimie
*Assistant Examiner*—Katrina Harris
(74) *Attorney, Agent, or Firm*—Knobbe Martens Olson & Bear LLP

(57) ABSTRACT

An engine has a lubrication system to lubricate at least a portion of the engine with lubricant. The lubrication system has a lubrication pump that periodically pressurizes the lubricant toward the portion of the engine. A first sensor senses an engine speed. A second sensor senses an engine load. A third sensor senses a temperature of the lubricant or the engine. A control device controls the lubrication pump. The control device determines a frequency of periodic pressurization by the lubrication pump based upon outputs from the first and second sensors. The control device determines a pressurization time of the lubrication pump based upon at least one of outputs from the first sensor, second sensor, third sensor, and a battery voltage.

28 Claims, 6 Drawing Sheets

LUBRICATION SUPPLY CONTROL SYSTEM

PRIORITY INFORMATION

This application is based on and claims priority under 35 U.S.C. §119 to Japanese Patent Application No. 2002-321470, filed on Nov. 5, 2002, the entire contents of which is hereby expressly incorporated by reference herein.

FIELD OF THE INVENTION

The present application relates to a lubrication system for an engine, and more particularly a lubrication system that incorporates a lubrication pump that pressurizes lubricant to a portion of an engine. The lubrication system is particularly useful in a two-stroke engine.

DESCRIPTION OF THE RELATED ART

In all fields of engine design, there is an increasing emphasis on obtaining more effective emission control. Recent two-cycle engines, therefore, incorporate a lubricant pump to deliver a desired amount of lubricant to lubricate internal portions of the engines. Mechanically operated pumps can be used as the lubricant pump. Such mechanical pumps, however, are not easily controlled to provide highly precise amounts of lubricant in response to engine operations. Electrically operable pumps tend to replace the mechanical pumps because higher precision controls are more widely available with such electrical pumps.

The electrical pumps can periodically pressurize lubricant under control of a control device such as, for example, an electronic control unit (ECU). The ECU can control a frequency of the periodic pressurization with, for example, an electronic control signal configured to operate the pump in accordance with a desired duty cycle. The higher the frequency, the greater the amount of the lubricant.

An electromagnetic solenoid pump is one type of such electrical pump. Japanese Laid Open Patent Publication 10-37730 discloses a lubrication system incorporating such an electromagnetic solenoid pump. The solenoid pump has a pumping piston reciprocally disposed in a pump housing. A plunger is coupled with the pumping piston. An electromagnetic solenoid can actuate the plunger. A control device controls the solenoid to selectively actuate or release the plunger such that the pumping piston periodically pressurizes the lubricant.

The control device disclosed in Japanese Laid Open Patent Publication 10-37730 has a control map that provides an amount of lubricant required by the engine versus an engine speed and determines a frequency of energization of the solenoid using the control map. The solenoid pump thus can pressurize a proper amount of lubricant in response to the engine speed of the engine.

In general, however, even though the engine speed is constant, an engine load can vary. For instance, if the engine powers a land vehicle, the engine load can increase when the vehicle ascends a slope. Also, if the engine powers a watercraft, the engine load can increase when the watercraft proceeds against wind. Under the circumstances, the engine requires a more appropriate amount of lubricant.

A battery voltage can also vary allowing the solenoid pump to be driven at different speeds, however the amount of lubricant that the engine requires must be maintained for all battery voltages.

The amount of lubricant inside a lubricant tank also decreases as the engine is operated. This varying volume of lubricant can also have an effect of the amount of lubricant delivered to the engine.

SUMMARY OF THE INVENTION

A need therefore exists for a lubrication system for a two-cycle engine that can provide an appropriate amount of lubricant to engine portions in every engine operation.

One aspect of the present invention involves a method for delivering a calculated lubricant amount from a lubricant system to an engine to lubricate at least a portion of the engine. The method comprises sensing an engine speed of the engine, sensing an engine load of the engine, and sensing a lubricant volume in the lubricant system. The method further comprises calculating the lubricant amount required by the engine based upon the sensed engine speed, the sensed engine load, the sensed lubricant volume, and a battery voltage and actuating a lubrication pump to deliver the calculated amount of lubricant.

Another aspect of the present invention involves a method for delivering a calculated lubricant amount from a lubricant system to an engine to lubricate at least a portion of the engine. The method comprises sensing at least one characteristic of the engine, calculating the lubricant amount required by the engine in accordance with said characteristic and a battery voltage range, and actuating a lubrication pump to deliver the calculated amount of lubricant.

Another aspect of the present invention involves a method for determining a correct amount of lubricant being delivered to an engine to lubricate at least a portion of the engine. The method comprises sensing an engine speed of the engine, sensing an engine load of the engine, and sensing an amount of lubricant volume in a lubrication system. The method further comprises calculating the amount of lubricant required by the engine based upon the sensed engine speed, the sensed engine load, the sensed lubricant volume, and a battery voltage and comparing the calculated lubricant amount to an actual measured lubricant amount from a lubricant level sensor. The method further comprises activating an alarm if the compared calculated lubricant level is not within a predetermined range of the actual lubricant level.

In accordance with another aspect of the present invention, an internal combustion engine comprises a lubrication system arranged to lubricate at least a portion of the engine with lubricant. The lubrication system has a lubrication pump that delivers the lubricant toward the portion of the engine. A first sensor is configured to sense an engine speed of the engine, a second sensor is configured to sense an engine load of the engine, and a third sensor is configured to sense a volume of lubricant in the lubrication system. A control device is configured to control the lubrication pump. The control device determines an amount of lubricant that is delivered by the lubrication pump based upon outputs from the first sensor, the second sensor, the third sensor, and a battery voltage to control the lubrication pump.

In accordance with another aspect of the present invention, an internal combustion engine comprises a lubrication system arranged to lubricate at least a portion of the engine with lubricant. The lubrication system has a lubricant tank, an alarm, and a lubrication solenoid that delivers the lubricant from the lubricant tank toward the portion of the engine. A sensor is configured to sense an engine speed of the engine, a second sensor is configured to sense an engine load of the engine, and a third sensor is configured to sense a lubricant level inside the lubricant tank. A control device is configured to compare a calculated lubricant level depending on outputs from the first sensor, the second sensor, and a battery voltage to an actual lubricant level output from the third sensor. The control device activates the alarm if the compared calculated lubricant level is not within a predetermined range of the actual lubricant level.

In accordance with another aspect of the present invention, an internal combustion engine comprises a lubrication system arranged to lubricate at least a portion of the engine with a lubricant. The lubrication system has a lubrication pump that delivers the lubricant toward the portion of the engine. The lubrication system has a means for controlling the lubrication pump to deliver an amount of lubricant based upon outputs from an engine speed sensor, an engine load sensor, a lubricant volume sensor, and a battery voltage.

In accordance with another aspect of the present invention, an internal combustion engine comprises a lubrication system arranged to lubricate at least a portion of the engine with lubricant. The lubrication system has a lubricant tank, an alarm, and a lubrication solenoid that delivers the lubricant from the lubricant tank toward the portion of the engine. The lubrication system has a means for comparing a calculated lubricant level depending on outputs from an engine speed sensor, an engine load sensor, and a battery voltage to an actual lubricant level output from a lubricant level sensor. The control device activates the alarm if the compared calculated lubricant level is not within a predetermined range of the actual lubricant level.

In accordance with another aspect of the present invention, an internal combustion two-stroke engine comprises a lubrication system arranged to lubricate at least a portion of the engine with a lubricant. The lubrication system has a lubrication pump driven by a solenoid that delivers the lubricant toward the portion of the engine. At least one engine sensor is configured to sense an engine characteristic, and a control device is configured to control the lubrication pump. The control device determines an amount of lubricant that is delivered by the lubrication pump based upon outputs from the at least one engine sensor and a battery voltage to control the lubrication pump.

For purposes of summarizing the invention, certain aspects, advantages and novel features of the invention have been described herein above. Of course, it is to be understood that not necessarily all advantages disclosed or taught herein may be achieved in accordance with any particular embodiment of the invention. Thus, the invention may be embodied or carried out in a manner that achieves or optimizes one advantage or group of advantages as disclosed or taught herein without necessarily achieving other advantages as may be disclosed, taught or suggested herein.

All of these aspects are intended to be within the scope of the invention herein disclosed. These aspects of the invention, as well as others, will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention disclosed herein are described below with reference to the drawings of a preferred embodiment, which is intended to illustrate and not to limit the invention. The drawings comprise the following figures in which.

DETAILED DESCRIPTION OF THE PREFERRED EMBODIMENT

The present lubrication system described below has particular utility in the context of a two-cycle engine for an outboard motor, and thus, is described in the context of such an outboard motor. The lubrication system, however, can be used with other types of engines employed by any machines whatsoever using engine power such as, for example, watercrafts (e.g., personal watercrafts), land vehicles (e.g., motorcycles) and utility machines (e.g., lawn mowers).

Figure 1:
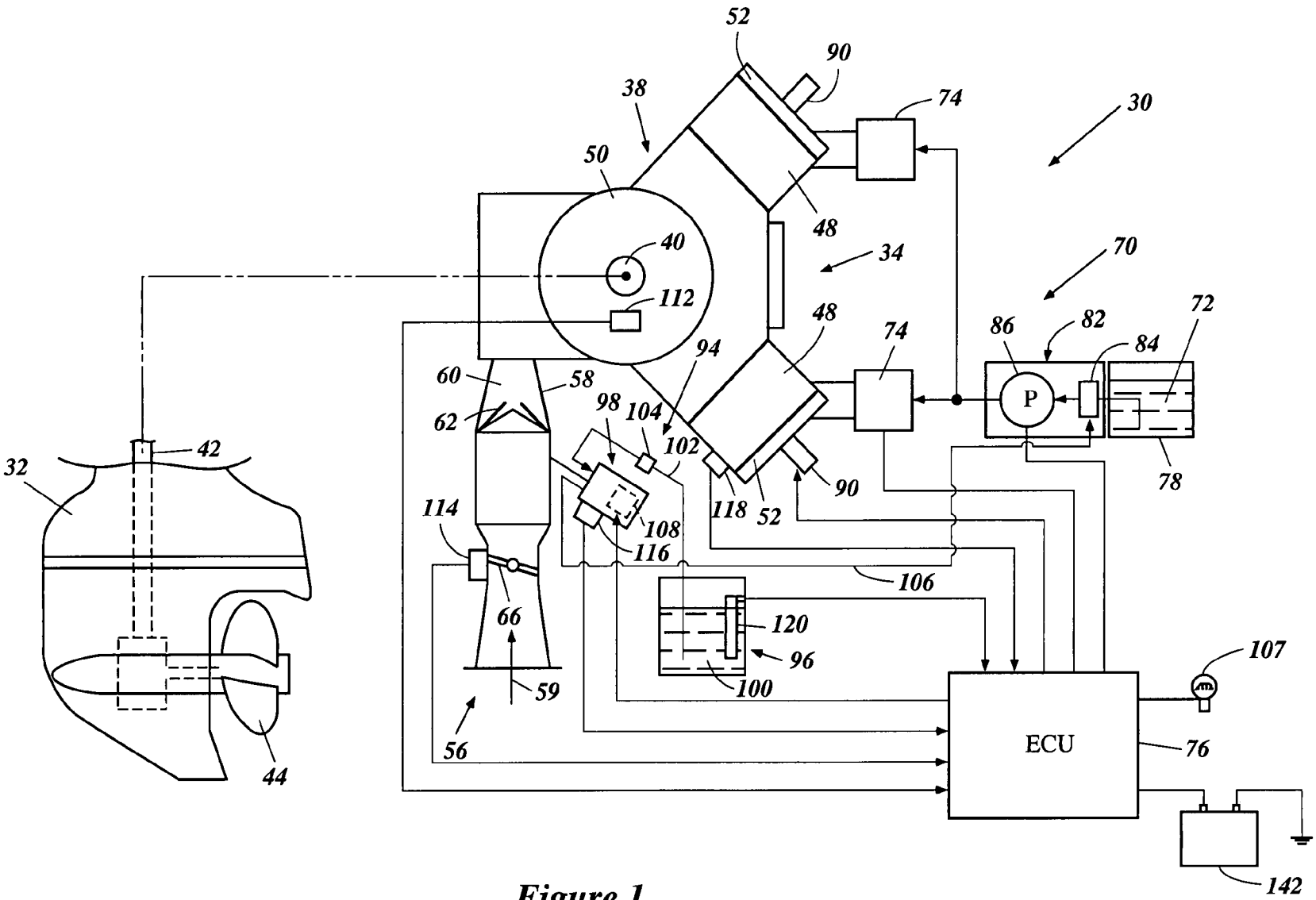
FIG. 1 illustrates a schematic view of an outboard motor that has an engine that incorporates a lubrication system configured in accordance with certain features, aspects and advantages of the present invention. An upper part of the outboard motor is broken away, and the engine and an air intake system for the engine are shown in a top plan view.

With reference to FIG. 1, an outboard motor 30 has a bracket assembly comprising a swivel bracket and a clamping bracket which are typically associated with a housing unit 32. The bracket assembly can mount the outboard motor 30 on an associated watercraft. The outboard motor 30 includes a power head that is positioned above the housing unit 32. The power head comprises a protective cowling assembly and an internal combustion engine 34. An engine support is unitarily or separately formed atop the housing unit 32 and forms a tray together with the cowling assembly. The tray holds a bottom of the engine 34 and the engine 34 is affixed to the engine support.

The engine 34 comprises an engine body 38 and a crankshaft 40 that is rotatably journaled on the engine body 38. The crankshaft 40 rotates about a generally vertically extending axis. This facilitates the connection of the crankshaft 40 to a driveshaft 42 mounted inside the housing unit 32.

A propulsion device is mounted on a lower portion of the housing unit 32 and the driveshaft 42 drives the propulsion device. The illustrated propulsion device is a propeller 44. The driveshaft 42 drives the propeller 44 through a transmission. The transmission includes a changeover mechanism that can change a rotational direction of the propeller 44 among forward, neutral and reverse.

The engine 34 operates on a two-cycle, crankcase compression principle. The illustrated engine 34 is generally configured in a V-shape, with a pair of cylinder banks 48 extending generally rearwardly. Each bank 48 defines one or more cylinder bores. In the illustrated embodiment, each bank 48 defines three cylinder bores. The cylinder bores extend generally horizontally and are vertically spaced apart from each other in the bank 48. As used in this description, the term "horizontally" means that the subject portions, members or components extend generally in parallel to the water line where the associated watercraft is resting when the outboard motor 30 is not tilted. The term "vertically" in turn means that portions, members or components extend generally normal to those that extend horizontally. Although the invention is described in conjunction with the engine 34, the inventions disclosed herein can be utilized with an engine having other cylinder numbers and other cylinder configurations.

The crankshaft 40 is journaled for rotation within a crankcase chamber defined in part by a crankcase member 50 that is affixed to the cylinder banks 48. Pistons (not shown) are reciprocally disposed within the cylinder bores. The pistons are coupled with the crankshaft 40 through connecting rods (not shown). The crankshaft 40 thus rotates with the reciprocal movement of the pistons.

Cylinder head assemblies 52 are affixed to each cylinder bank 48 to close open ends of the respective cylinder bores. Each cylinder head assembly 52 defines a plurality of recesses on its inner surface corresponding to the cylinder bores. Each of these recesses defines a combustion chamber together with the cylinder bore and the piston.

The engine 34 preferably is provided with an air intake system 56 that delivers air to each section of the crankcase chamber associated with each cylinder bore. The air finally is supplied to the combustion chambers through a route described below. The intake system 56 comprises a plurality of air intake conduits 58. The air is drawn into the respective intake conduits 58 through an air inlet device as indicated by the arrow 59. The air intake device preferably defines a plenum chamber. Each air intake conduit 58 defines an air intake passage 60 connecting the plenum chamber and each section of the crankcase chamber associated with each combustion chamber. The air drawn into the plenum chamber thus is delivered to the sections of the crankcase chamber through the intake conduits 58.

Each intake conduit 58 preferably incorporates a reed valve 62 that allows the air to flow into the section of the crankcase chamber and prevents the air in the section of the crankcase chamber from flowing back to the plenum chamber. Each intake conduit 58 also incorporates a throttle valve 66 between the plenum chamber and the reed valve 62. Each throttle valve 66 preferably is a butterfly type and is pivotally journaled on each intake conduit 58 to regulate an amount of air flowing there through. The operator can change the pivotal position, i.e., a throttle valve position or throttle valve open degree, through a suitable control mechanism (not shown).

The pistons, during their movement toward the crankshaft 40 preliminarily compress the air drawn into the respective sections of the crankcase chamber. The air, then, moves into the combustion chambers through a scavenge system. The scavenge system preferably is formed as a Schnurle-type system that comprises a pair of main scavenge passages connected to each cylinder bore and positioned on diametrically opposite sides. These main scavenge passages terminate in main scavenge ports so as to direct scavenge flowing air into the combustion chamber.

In addition, an auxiliary scavenging passage is formed between the main scavenge passages and terminates in an auxiliary scavenging port which also provides a scavenge airflow. Thus, at the scavenge stroke, the air in the crankcase chamber is transferred to the combustion chambers to be further compressed by the pistons during their movement toward the cylinder head assemblies 52. The scavenge ports are selectively opened and closed as the piston reciprocates.

The engine 34 preferably is provided with a fuel supply system 70 that supplies fuel 72 to the combustion chambers. The illustrated fuel supply system 70 is configured to operate under a direct fuel injection principle in which the fuel is directly sprayed into the combustion chambers. The fuel supply system 70 comprises fuel injectors 74 allotted to the respective combustion chambers. The fuel injectors 74 preferably are mounted on the cylinder head assemblies 52.

A control device controls the fuel injectors 74 to inject fuel. In the illustrated embodiment, the control device preferably is an electronic control unit (ECU) 76. The ECU 76 preferably controls an injection timing and a duration of each fuel injection. The ECU 76 comprises at least a central processing unit (CPU) and at least one storage unit or memory. The ECU 76 preferably controls engine related components other than the fuel injectors 74, which will be described shortly. The memory stores control programs and reference maps for controlling the components including the fuel injectors 74. The CPU preferably conducts the control programs to control the engine-related components in referring to the maps based upon output signals from sensors.

The fuel supply system 70 additionally comprises a fuel supply tank 78 that contains the fuel 72. The fuel supply tank 78 preferably is placed in the hull of the watercraft. A fuel delivery unit 82 is provided between the fuel supply tank 78 and the fuel injectors 74 and particularly on the outboard motor 30 to deliver the fuel 72 to the fuel injectors 74. The fuel delivery unit 82 preferably comprises a vapor separator tank 84 and a plurality of fuel pumps 86, although FIG. 1 schematically illustrates the fuel delivery unit 82. The vapor separator tank 84 temporarily contains the fuel 72 and also can separate vapor from the fuel 72 to prevent vapor lock from occurring in the fuel supply system 70. The fuel pumps 86 preferably include low pressure fuel pumps and high pressure fuel pumps to develop an extremely high pressure sequentially. At least one of the fuel pumps operates under control of the ECU 76. The fuel delivery unit 82 also comprises high-pressure regulators to regulate the developed high pressure at a fixed or constant pressure level. Excessive fuel preferably returns back to the vapor separator 84.

With continued reference to FIG. 1, the engine 34 preferably is provided with an ignition or firing system. Spark plugs 90 are affixed to the cylinder head assemblies 52 exposing at least two electrodes (not shown) into the combustion chambers. The spark plugs 90 ignite air/fuel charges in the combustion chambers under control of the ECU 76.

The engine 34 preferably is provided with an exhaust system (not shown) that guides burned charges, i.e., exhaust gases to an external location from the combustion chambers. The exhaust system has one or more exhaust ports that are formed in the cylinder banks 48 to communicate with each combustion chamber. The exhaust ports are selectively opened or closed with the reciprocal movement of each piston. The exhaust system can discharge the exhaust gases to the body of water, which surrounds the outboard motor 30, through a hub of the propeller 44 above idle operation. At idle, the exhaust gasses can be discharged to the atmosphere through an above-water outlet.

Each fuel injector 74 sprays fuel directly into the associated combustion chamber. The sprayed fuel is mixed with the air delivered through the scavenge passages to an air/fuel charge. The spark plug 90 fires, the air/fuel charge. The injection timing and the duration of the fuel injection and the firing timing are under control of the ECU 76. Once the air/fuel charge burns in each combustion chamber, the pressure produced in the combustion chamber moves each piston. At this time, exhaust ports are uncovered. The burnt charge or exhaust gases thus are discharged through the exhaust system.

With further reference to FIG. 1, the engine 34 is provided with the foregoing lubrication system, which now is indicated by the reference numeral 94. The lubrication system 94 preferably comprises a lubricant tank 96 and a lubrication pump 98. The lubricant tank 96 contains lubricant oil 100. A lubricant supply passage 102 couples the lubrication tank 96 with the lubrication pump 98. A lubricant filter 104 is preferably positioned in the lubricant supply passage 102 between the lubricant tank 96 and the lubrication pump 98 to remove any unwanted foreign material contained in the lubricant 100. Preferably but not necessarily, the lubricant tank 96 is mounted on the engine body 38. A lubrication warning light 107 is illuminated by the ECU 76 when a problem exists with the lubrication system 94. The operation of the lubrication warning light will be described in greater detail below.

An auxiliary lubricant tank (not shown), which preferably has a larger capacity than the lubricant tank 96, preferably is placed in the watercraft to keep a sufficient amount of the lubricant 100. Preferably, the auxiliary lubricant tank is connected to the lubricant tank 96 through a proper lubricant passage and a pump pressurizes the lubricant in the auxiliary lubricant tank to the lubricant tank 96.

Preferably, the lubrication pump 98 periodically pressurizes lubricant toward portions of the engine 34 that benefit from lubrication. In the illustrated arrangement, the lubrication pump 98 has one inlet port and six outlet ports. The inlet port is connected to the lubricant tank 96 through the lubricant supply passage 102. The outlet ports preferably are connected to the respective intake passages 60 upstream of the reed valves 62 to inject the lubricant 100 into the intake passages 60. The lubricant is drawn into the crankcase chamber together with the air and is delivered to the engine portions such as, for example, connecting portions of the connecting rods with the pistons and also with the crankshaft 40.

In one variation, the outlet ports can be positioned downstream of the reed valves 62. In another variation, the outlet ports can be connected directly to the crankcase chamber within the crankcase member 50 as indicated by the phantom line of FIG. 1.

In the illustrated arrangement, some forms of direct lubrication can be additionally employed for delivering lubricant directly to certain engine portions. For example, an extra outlet port can be formed on the lubrication pump 98 to deliver part of the lubricant 100 to the vapor separator tank 84 through a lubricant delivery passage 106. Alternatively, the lubricant delivery passage 106 can be branched off from the lubricant supply passage 102; one branch passage directed to the lubrication pump 98 and another branch passage directed to the vapor separator tank 84. In this alternative, a lubricant delivery pump is additionally necessary in the lubricant delivery passage 106 to pressurize the part of the lubricant 100 to the vapor separator tank 84.

The lubrication pump 98 preferably comprises an electromagnetic solenoid actuator 108 that is controlled by the ECU 76. The lubrication pump 98 and the solenoid actuator 108 will be described in greater detail below.

The outboard motor 30 can have other systems, devices and components that are not described above. For instance, a water cooling system can be provided to cool the engine 34 and the exhaust system with the water. The cooling system can be an open-loop type that takes water into the system from the body of water and discharges the water thereto after the water has traveled around water jackets in the engine body 38 and portions of the exhaust system.

With reference to FIG. 1, as described above, the ECU 76 controls at least the fuel injectors 74, the spark plugs 90, one of the fuel pumps 86 and the lubrication pump 98. In order to control these components, the outboard motor 30 is provided with a number of sensors that sense either engine running conditions, ambient conditions or conditions of the outboard motor 30 that can affect engine performance.

There is provided a crankshaft angle position sensor 112 that senses a crankshaft angle position and outputs a crankshaft angle position signal to the ECU 76. The ECU 76 can calculate an engine speed N in revolutions per minute (r.p.m.) using the crankshaft angle position signal versus time. In this regard, the crankshaft angle position sensor 112 and part of the ECU 76 form an engine speed sensor. The crankshaft angle position sensor 112, or another sensor, can also be used to provide reference position data to the ECU 76 for timing purposes, such as for the timing of fuel injection and/or ignition timing.

Operator's demand or engine load, as indicated by an angular position Thθ of the throttle valve 66, is sensed by a throttle valve position sensor 114 which outputs a throttle valve position or load signal to the ECU 76. Alternatively or additionally, an intake pressure sensor can be provided downstream of the throttle valve 66 in the intake passage 60 to sense the intake pressure that can also represent the engine load. The intake pressure sensed by the intake pressure sensor is a negative pressure unless the reed valve 62 closes. Further, an air amount sensor such as, for example, an air flow meter can alternatively or additionally be provided to sense an amount of the air in the intake passage 60 that can also represent the engine load.

A lubricant temperature sensor 116 is provided at the lubrication pump 98 to sense a temperature $T_L$ of the lubricant 100 that is injected to the intake passages 60 and outputs a lubricant temperature signal to the ECU 76. In one variation, the lubricant temperature sensor 116 can be positioned at the lubricant tank 96.

An engine temperature sensor 118 is provided at a portion of the engine body 38 to sense a temperature $T_E$ of the engine body 38 and outputs an engine temperature signal to the ECU 76. In one variation, the engine temperature sensor 118 can sense a temperature of the cooling water in the water jackets instead of directly sensing the temperature of the engine body 38.

A lubricant level sensor 120 is positioned in the lubricant tank 96 to sense a lubricant level in the lubricant tank 96 and outputs a lubricant level signal to the ECU 76. The ECU 76 can control the lubricant delivery pump to pressurize the lubricant in the auxiliary lubricant tank to the lubricant tank 96 when the lubricant level is lower than a preset level.

Figure 2:
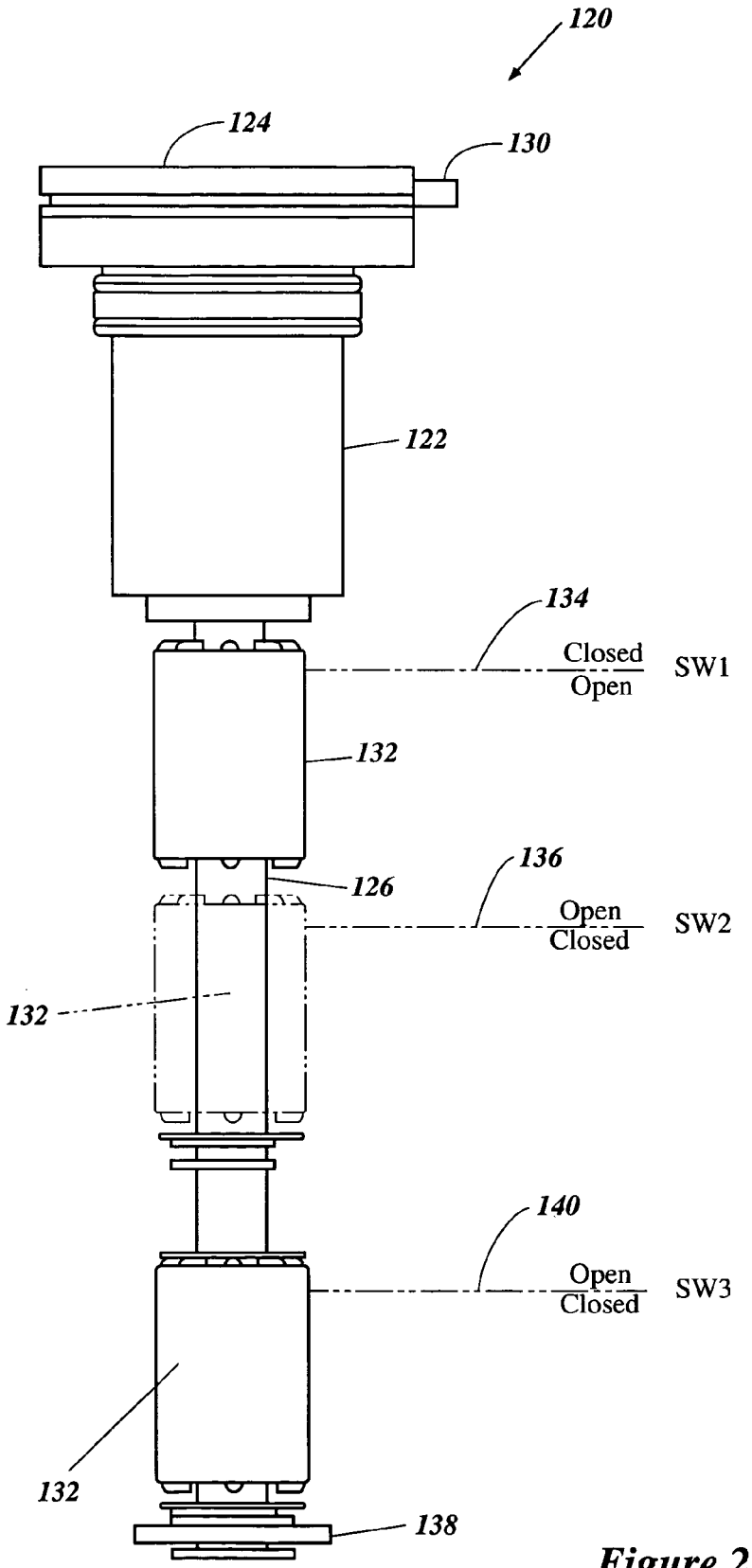
FIG. 2 illustrates a side view of a lubricating oil level gauge applied in the lubrication system of FIG. 1.

With reference to FIG. 2, a structure and an operation of the lubricant level sensor will be described. The lubricant level sensor 120 preferably comprises a main body 122, a mounting flange 124, and a guide member 126. A float 132 that has a density lower than the lubricant 100 is positioned on the guide member 126 and is constructed to move along the guide member 126 depending on the volume of lubricant inside the lubricant tank 98. A wire cable 130 communicates information relating to various possible positions of a float 132 with the ECU 76. An example of another system of communicating data from the lubricant level sensor to the ECU is also possible, for example, but not limited to a wireless communication system.

The float 132 can change position along the guide member 126 according to different volume levels of lubricant 100 inside the lubricant tank 96. Within the guide member 126 are three switches, SW1 (not shown), SW2 (not shown), and SW3 (not shown). As the float 132 moves along the guide member 126, each switch can be triggered by the float position. For example, a switch contact can be constructed to close or open when the float 132 comes within a predetermined distance from the switch. Other constructions of the switch besides the reed switch are also possible as understood by someone familiar in the art.

As the float 132 passes across each reed switch, the switches can be closed depending on the reed switch orientation. For example, the first switch SW1 is closed when the float 132 rises above a predetermined position illustrated by the SW1 dashed line 134 in FIG. 2. As lubricant is used to lubricate the engine 38 and the volume of the lubricant 100 inside the lubricant tank 96 decreases, the float position lowers and closes the switch SW2 after passing by a predetermined position 136 on the guide member 126. As the lubricant volume further decreases, the float closes the switch SW3 after passing by a predetermined position 140 on the guide member 126. The float 132 is prevented from leaving the guide member 126 by a stopper 138 when the lubricant volume reaches a level where the lubricant is unable to support the float 132.

The solenoid 108 is energized when an ON signal is provided from the ECU 76 and is de-energized when an OFF signal is provided or when the ON signal is not provided. An electric power supply device such as, for example, a battery 142 (FIG. 1) preferably is provided to supply electric power at least to the ECU 76 and the solenoid 108. The solenoid 108 actuates a plunger (not shown) while energized and releases the plunger while de-energized. Preferably, the ECU 76 provides the solenoid 108 with a sequential control command in which a high voltage part and a low voltage part alternately and repeatedly appear, which is also known as a "duty cycle". The high voltage part corresponds to the ON signal and the low voltage part corresponds to the OFF signal.

Figure 3:
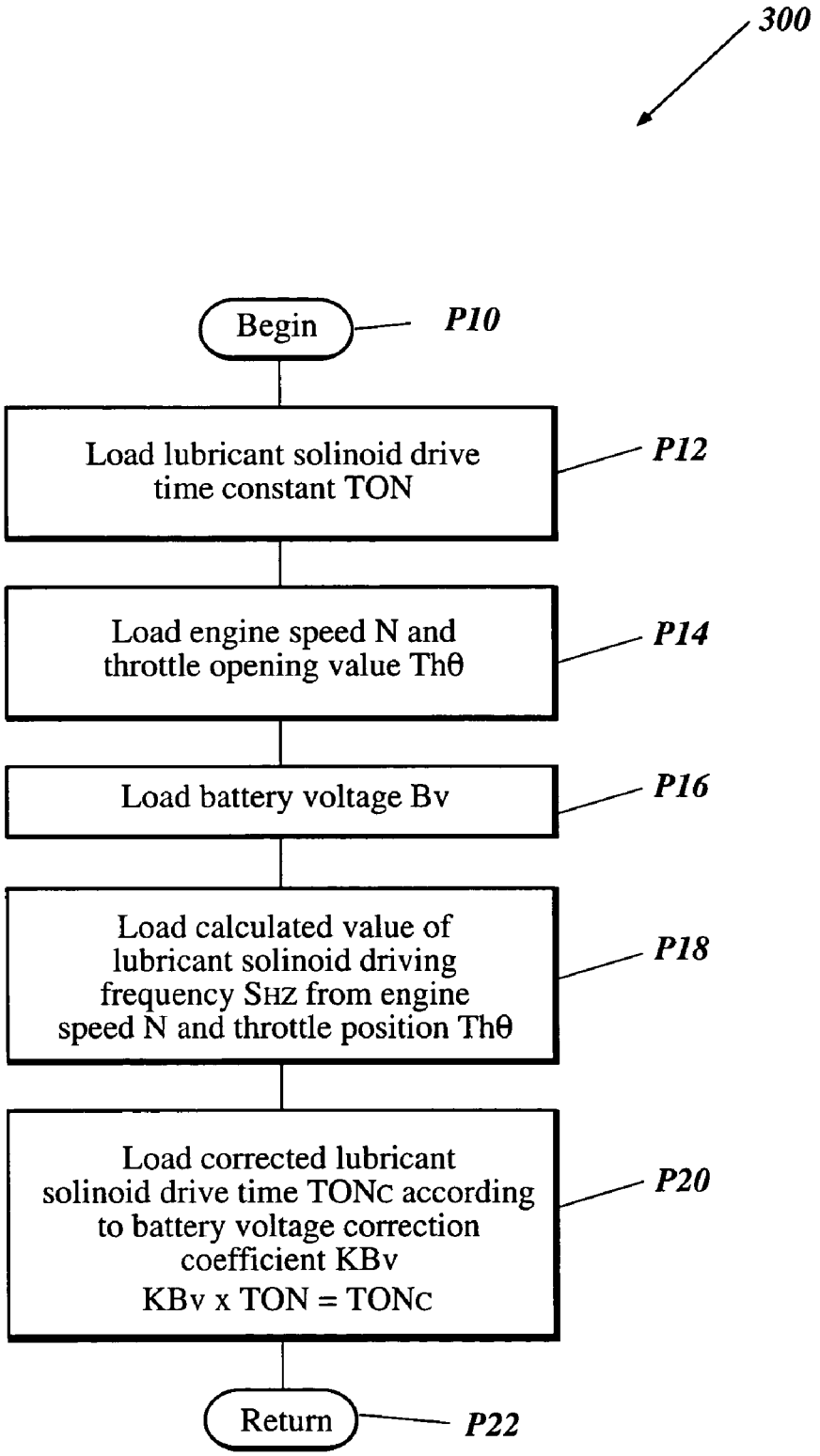
FIG. 3 illustrates a flow chart of a preferred control program with which lubrication system variables are loaded into an engine control unit of FIG. 1.

With reference to FIG. 3, a control routine 300 is shown that is arranged and configured in accordance with certain features, aspects, and advantages of the present invention. The control routine 300 represents an initial routine program performed by the ECU 76 when power from the battery 142 is first delivered to the ECU 76, i.e. when the operator turns on a power switch.

The control routine 300 begins at a first operation block P10 and moves to a second operation block P12 where a lubricant solenoid drive constant $T_{on}$ is loaded into memory. The lubricant solenoid drive constant $T_{on}$ represents a predetermined preset constant that is received from the lubricant solenoid and loaded into the ECU 76. The control routine 300 then moves to an operation block P14.

In operation block P14 an engine speed N and a throttle opening value Thθ is loaded into memory in the ECU 76. The engine speed N along with the throttle opening value Thθ can allow the ECU 76 to calculate the engine load. The control routine 300 then moves to an operation block P16.

In operation block P16 the control routine 300 loads the battery voltage $B_v$ into memory in the ECU 76. The battery voltage $B_v$ can differ depending on engine temperature, the outside environment, as well as the temperature of the lubricant inside the lubricant tank 96. The control routine 300 then moves to an operation block P18.

In operation block P18 a calculated value of a lubricant solenoid driving frequency $S_{Hz}$ is calculated from the engine speed N and the throttle Position Thθ and the lubricant solenoid driving frequency $S_{Hz}$ is loaded into memory into the ECU 76. The calculation of $S_{Hz}$ will be described in greater detail below with reference to FIG. 4. The control routine 300 then moves to an operation block P20.

In operation block P20 a corrected lubricant solenoid drive time $T_{onc}$ according to a battery voltage correction coefficient $kB_v$ is loaded into memory in the ECU 76. The corrected lubricant solenoid drive time $T_{onc}$ is equal to the battery voltage correction coefficient $kB_V$ multiplied by the lubricant solenoid drive time constant $T_{on}$, i.e.:

$$kB_V \times T_{on} = T_{onc}$$

The corrected lubricant solenoid drive time $T_{onc}$ allows the ECU 76 to drive the lubricant solenoid 108 at a corrected drive time according to any variations in battery voltage. For example, if the battery voltage is below a predetermined value the ECU 76 can drive the lubricant solenoid 108 at a higher rate to compensate for the low battery voltage. If the battery voltage is higher than a predetermined value the ECU 76 can drive the lubricant solenoid 108 at a lower rate to compensate for the high battery voltage. The control routine then moves to an operation block P22 and returns.

In a preferred embodiment, the lubrication pump 98 periodically pressurizes the lubricant 100 under control of the ECU 76. Preferably, the ECU 76 determines a frequency of periodic pressurization by the lubrication pump 98 and also determines a pressurization time of the lubrication pump 98.

Figure 4:
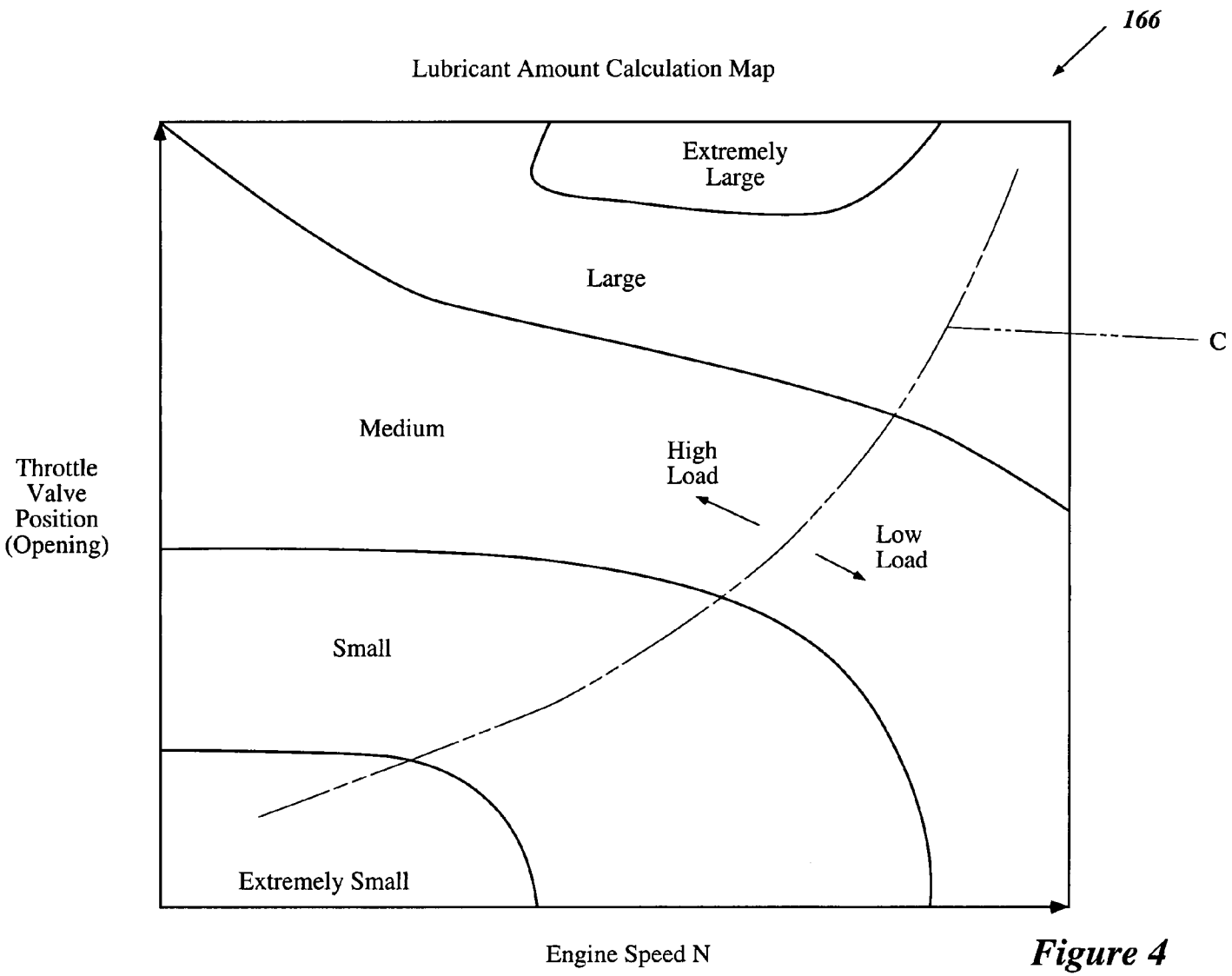
FIG. 4 illustrates a lubricant amount control map that provides an amount of lubricant corresponding to an engine speed and an engine load.

In a preferred embodiment, the ECU 76 first calculates a lubricant amount using a lubricant amount calculation map 166 shown in FIG. 4. That is, the lubricant amount is determined based upon the engine speed N, the throttle valve position Thθ, and the battery voltage $B_V$. In this embodiment, the engine load can be calculated using the throttle valve position Thθ. As described above, the engine speed N is calculated by the ECU 76 using the crankshaft angle position sensed by the crankshaft angle position sensor 112. The throttle valve position Thθ is provided by the throttle valve position sensor 114. The intake pressure or the air amount sensed by the intake pressure sensor or the air amount sensor, respectively, can be used instead of or in combination with the throttle valve position to calculate the engine load.

With reference to FIG. 4, the lubricant amount calculation map 166 provides various lubricant amounts ranging as extremely small, small, medium, large and extremely large amount. The lubricant amount calculation map 166 provides the various lubricant amounts in accordance with the lubricant solenoid driving frequency $S_{Hz}$, which is calculated by the ECU 76 from the engine speed N and the throttle Position Thθ. In general, the lubricant amount is extremely small when both the engine speed N and the engine load Thθ are low. On the other hand, the lubricant amount is extremely large generally when both the engine speed N and the engine load Thθ are high. A phantom line C shows a typical change of the lubricant amount regarding the engine 34 of the outboard motor 30. The area under the line C generally represents a low load area relative to the engine speed N, while the area above the line C generally represents a high load area relative to the engine speed N.

Then, the ECU 76 calculates the lubricant solenoid driving frequency $S_{Hz}$ from a driving frequency map (not shown) that is based on the amount of lubricant calculated in the map in FIG. 4.

Figure 5:
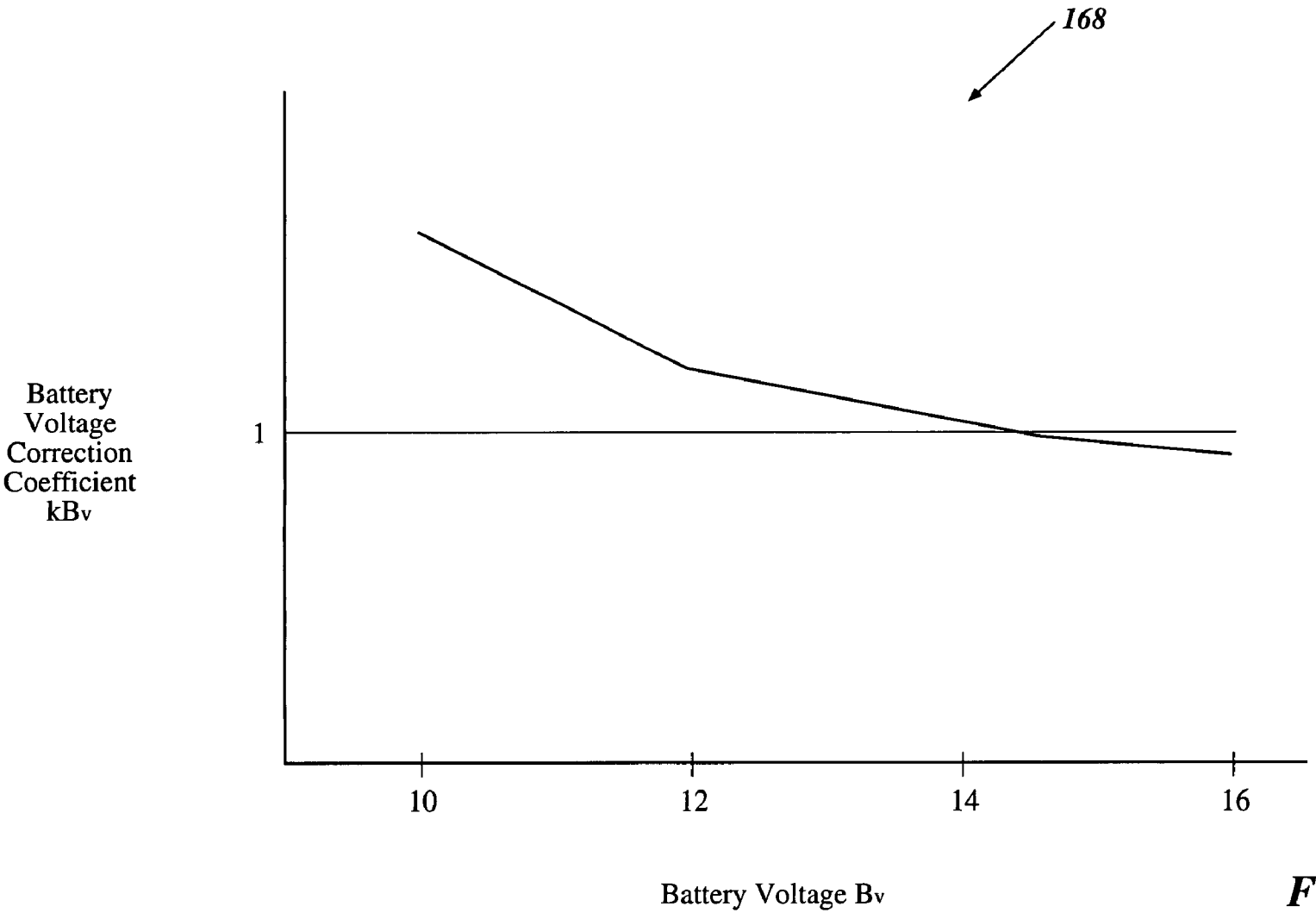
FIG. 5 illustrates a lubricant amount adjustment calculation map that provides an adjustment coefficient corresponding to a battery voltage.

FIG. 5 illustrates an adjustment coefficient calculation map 168 that is used by the ECU 76 in this embodiment. The battery voltage $B_V$ varies generally in accordance with the battery voltage correction coefficient $kB_V$. The ECU 76 thus can use an adjustment coefficient $KB_V$ in connection with the battery voltage $B_V$ to determine the correct lubricant solenoid driving frequency $S_{Hz}$.

The adjustment coefficient calculation map 168 provides a specific adjustment coefficient $kB_V$ corresponding to a specific battery voltage $B_V$. Generally, the coefficient $kB_V$ becomes smaller when the battery voltage $B_V$ becomes higher as shown in FIG. 5. The coefficient $kB_V$ is "1" generally at a reference battery voltage. In the preferred embodiment the reference voltage can be a voltage slightly higher than 14 volts. The battery voltage $B_V$ is sensed by the ECU 76. The ECU 76 calculates the corrected lubricant solenoid drive time $T_{onc}$ by multiplying the lubricant solenoid drive constant $T_{on}$ by the battery voltage correction coefficient $kB_v$. That is, the correction equation is indicated as follows:

$$kB_V \times T_{on} = T_{onc}$$

Basically, the ECU 76 is ready to control the solenoid actuator 108 after the ECU 76 has calculated the corrected battery voltage $kB_V$. In the preferred embodiment, the ECU 76 further calculates the duration $T_{on}$ of the solenoid 108 based on the throttle position Thθ and the engine speed N. The solenoid drive time constant $T_{on}$ is then corrected by the ECU 76 by the corrected battery voltage $kB_V$ providing the engine 38 and the fuel supply system 70 with the correct amount of lubricant regardless of the change in battery voltage $B_V$.

Figure 6:
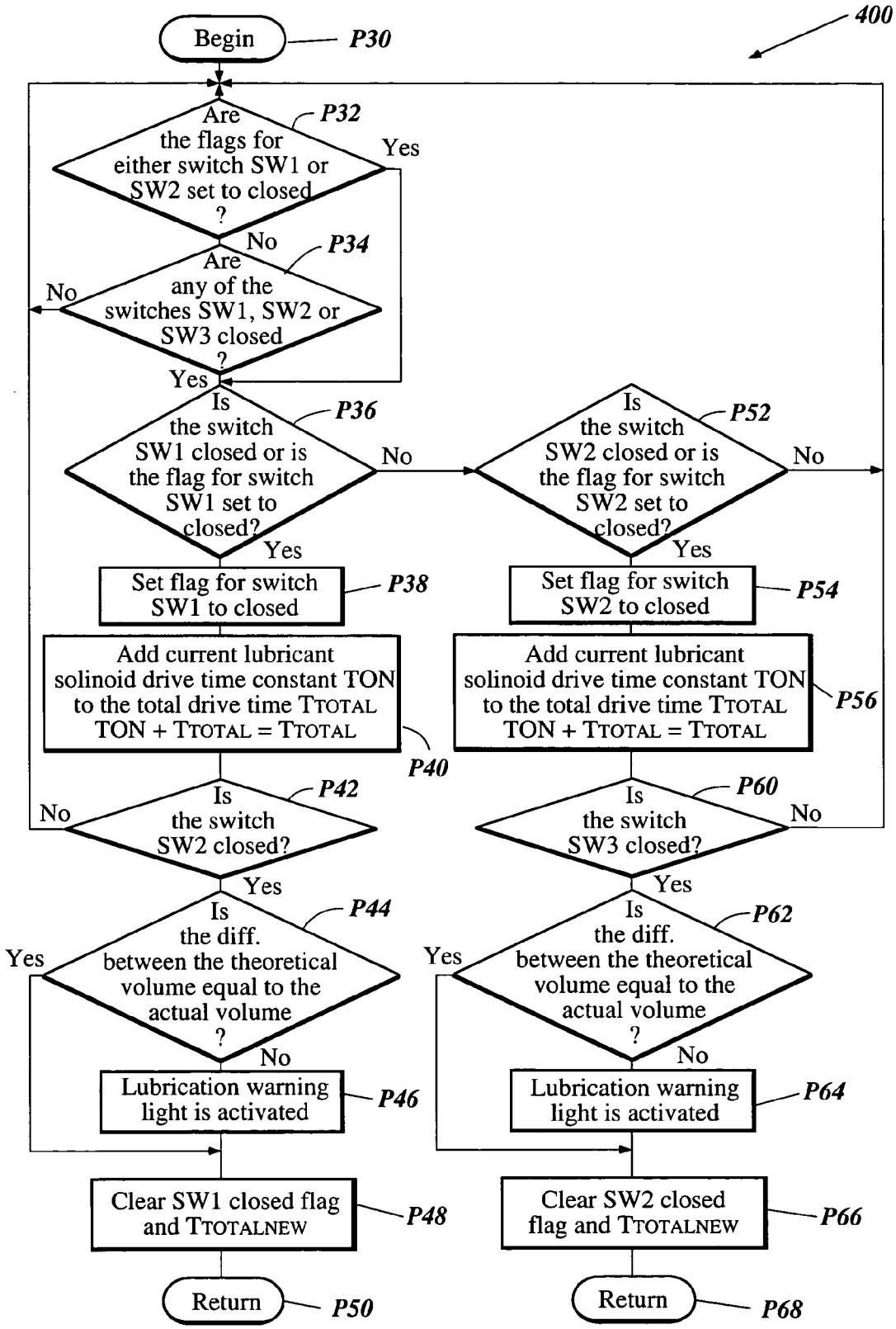
FIG. 6 illustrates another flow chart of a preferred control program with which a control device of the lubrication system controls the lubrication pump of FIG. 1.

With reference to FIG. 6, a control routine 400 is shown that is arranged and configured in accordance with certain features, aspects, and advantages of the present invention. The control routine 400 determines if the correct amount of lubricant is being supplied to the engine 38 and the fuel supply system 70 by comparing the actual volume of lubricant inside the lubricant tank with a theoretical or calculated volume. The lubricant level sensor 120 provides an actual lubricant volume $L_{actvol}$. The battery voltage $B_V$, engine speed N, the engine temperature, and lubricant temperature can be used to derive a theoretical lubricant volume $L_{thvol}$.

The control routine 400 begins at a block P30 and moves to a decision block P32 where it is determined if flags for either switch SW1 or SW2 are set to closed. If in decision block P32 it is determined that the flags for either switch SW1 or SW2 are not set to closed, the control routine 400 moves to a decision block P34. If, however, in decision block P32 it is determined that the flags for either switch SW1 or SW2 are set to closed, the control routine 400 moves to a decision block P36.

In decision block P34 it is determined if any of the switches SW1, SW2, or SW3 are closed. If in decision block 34 it is determined that none of the switches SW1, SW2, or SW2 are closed, the control routine 400 returns to the decision block P32. If, however, in decision block P34 it is determined that any of the switches SW1, SW2, or SW3 are closed, the control routine 400 moves to the decision block P36.

In decision block P36, it is determined if the switch SW1 is closed or if the flag for the switch SW1 is set to closed. If it is determined that the switch SW1 is not closed, nor the flag for the switch SW1 is set to closed, the control routine 400 moves to a decision block P52. If, however, in decision block P36 it is determined that the switch SW1 is closed or the flag for the switch SW1 is set to closed, the control routine 400 moves to an operation block P38.

In operation block P38, the control routine 400 sets the flag for switch SW1 to closed. The control routine 400 then moves to an operation block P40.

In operation block P40 the control routine 400 adds the current lubricant solenoid drive time constant $T_{on}$ to a total drive time $T_{total}$ to yield a new drive time $T_{total}$, i.e., $$T_{on} + T_{total} = T_{total}.$$

The equation above allows the ECU 76 to calculate a total actual amount of time the lubricant solenoid 108 has been operating. The total actual amount of time calculated can be used to derive the actual lubricant volume $L_{actvol}$.

The control routine 400 then moves to a decision block P42.

In decision block P42, it is determined if the switch SW2 is closed. It is determined if the switch SW2 is closed in decision block P42 as a precaution to assure that the actual lubricant level is determined correctly. For example, if it is determined that switch SW1 is closed in decision block P36, yet the lubricant tank 96 is not full, the control routine 400 determines if the switch SW2 is closed in decision block P42 to assure the correct level of lubricant.

If in decision block P42 it is determined that the switch SW2 is not closed, the control routine 400 returns to the decision block P32. If, however, in decision block P42 it is determined that the switch SW2 is closed, the control routine 400 moves to a decision block P44.

In decision block P44, it is determined if the difference between the theoretical lubricant volume $L_{thvol}$ and the actual lubricant volume $L_{actvol}$ is within a predetermined value. If in decision block P44, it is determined that the difference between the theoretical lubricant volume $L_{thvol}$ and the actual lubricant volume $L_{actvol}$ is within a predetermined value, the control routine 400 moves to an operation block P48. If, however, in decision block P44, it is determined that the difference between the theoretical lubricant volume $L_{thvol}$ and the actual lubricant volume $L_{actvol}$ is not within a predetermined value, the control routine 400 moves to an operation block P46.

In operation block P46, the control routine 400 activates the lubricant warning light 107 to warn the operator that a fault, such as a clogged fuel filter is present. The control routine 400 then moves to an operation block P48.

In operation block P48, the control routine 400 clears the switch SW1 closed flag and clears the theoretical lubricant volume $L_{thvol}$. The control routine 400 then moves to an operation block P50 where it returns.

In decision block P52, it is determined if the switch SW2 is closed or if the flag for the switch SW2 is set to closed. If it is determined that the switch SW2 is not closed, nor the flag for the switch SW2 is set to closed, the control routine 400 returns to the decision block P32. If, however, in decision block P36 it is determined that the switch SW2 is closed or the flag for the switch SW2 is set to closed, the control routine 400 moves to an operation block P54.

In operation block P54, the control routine 400 sets the flag for switch SW2 to closed. The control routine 400 then moves to an operation block P56.

In operation block P56 the control routine 400 adds the current lubricant solenoid drive time constant $T_{on}$ to a total drive time $T_{total}$ to yield a new drive time $T_{total}$, i.e., $$T_{on} + T_{total} = T_{total}$$

The equation above allows the ECU 76 to calculate a total actual amount of time the lubricant solenoid 108 has been operating. The total actual amount of time calculated can be used to derive the actual lubricant volume $L_{actvol}$.

The control routine 400 then moves to a decision block P60.

In decision block P60, it is determined if the switch SW3 is closed. If in decision block P60 it is determined that the switch SW3 is not closed, the control routine 400 returns to the decision block P32. If, however, in decision block P60 it is determined that the switch SW3 is closed, the control routine 400 moves to a decision block P62.

In decision block P62, it is determined if the difference between the theoretical lubricant volume $L_{thvol}$ and the actual lubricant volume $L_{actvol}$ is within a predetermined value. If in decision block P62, it is determined that the difference between the theoretical lubricant volume $L_{thvol}$ and the actual lubricant volume $L_{actvol}$ is within a predetermined value, the control routine 400 moves to an operation block P66. If, however, in decision block P62, it is determined that the difference between the theoretical lubricant volume $L_{thvol}$ and the actual lubricant volume $L_{actvol}$ is not within a predetermined value, the control routine 400 moves to an operation block P64.

In operation block P64, the control routine 400 activates the lubricant warning light 107. The control routine 400 then moves to an operation block P66.

In operation block P66, the control routine 400 clears the switch SW1 closed flag and clears the theoretical lubricant volume $L_{thvol}$. The control routine 400 then moves to an operation block P68 where it returns.

As thus described, the lubrication system 94 in the preferred embodiment can provide an appropriate amount of lubricant to the engine portions in every engine operation. Additionally, because of the appropriate amount of lubricant, no white smoke can be made in the discharged exhaust gases.

Although this invention has been disclosed in the context of a certain preferred embodiment and examples, it will be understood by those skilled in the art that the present invention extends beyond the specifically disclosed embodiment to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combination or sub-combinations of the specific features and aspects of the embodiments or variations may be made and still fall within the scope of the invention. It should be understood that various features and aspects of the disclosed embodiment can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A method for delivering a calculated lubricant amount from a lubricant system to an engine to lubricate at least a portion of the engine, the method comprising sensing an engine speed of the engine, sensing an engine load of the engine, sensing a lubricant volume in the lubricant system, calculating the lubricant amount required by the engine based upon the sensed engine speed, the sensed engine load, the sensed lubricant volume, and a battery voltage and actuating a lubrication pump to deliver the calculated amount of lubricant, wherein the lubricant amount is maintained at at least a predetermined amount based on a lubricant amount control map when the battery voltage is below a predetermined value.

2. The method of claim 1, including employing a solenoid to actuate the lubrication pump.

3. The method of claim 2, including determining a solenoid actuated frequency of periodic lubricant pressurization from the sensed engine speed, the sensed engine load, the sensed lubricant volume, and the battery voltage.

4. A method for delivering a calculated lubricant amount from a lubricant system to an engine to lubricate at least a portion of the engine, the method comprising sensing at least one characteristic of the engine, calculating the lubricant amount required by the engine in accordance with said characteristic and a battery voltage range, and actuating a lubrication pump to deliver the calculated amount of lubricant, wherein the lubricant amount is maintained at at least a predetermined amount based on a lubricant amount control map when the battery voltage is below a predetermined value.

5. The method of claim 4, including employing a solenoid to actuate the lubrication pump.

6. The method of claim 5, including determining a solenoid actuated frequency of periodic lubricant pressurization from the sensed engine characteristic and the battery voltage range.

7. The method of claim 4, including determining the calculated lubricant amount using a battery range between 10 and 16 volts.

8. A method for determining a correct amount of lubricant being delivered to an engine to lubricate at least a portion of the engine, the method comprising sensing an engine speed of the engine, sensing an engine load of the engine, sensing an amount of lubricant volume in a lubrication system, calculating the amount of lubricant required by the engine based upon the sensed engine speed, the sensed engine load, the sensed lubricant volume, and a battery voltage and comparing the calculated lubricant amount to an actual measured lubricant amount from a lubricant level sensor, activating an alarm if the compared calculated lubricant level is not within a predetermined range of the actual lubricant level.

9. The method of claim 8, wherein the activated alarm is audible or visual or both audible and visual.

10. An internal combustion engine comprising a lubrication system arranged to lubricate at least a portion of the engine with lubricant, the lubrication system having a lubrication pump that delivers the lubricant toward the portion of the engine, a first sensor configured to sense an engine speed of the engine, a second sensor configured to sense an engine load of the engine, a third sensor configured to sense a volume of lubricant in the lubrication system, and a control device configured to control the lubrication pump, the control device determining an amount of lubricant that is delivered by the lubrication pump based upon outputs from the first sensor, the second sensor, the third sensor, and a battery voltage to control the lubrication pump, wherein the control device maintains the lubricant amount at at least a predetermined amount based on a lubricant amount control map when the battery voltage is below a predetermined value.

11. The internal combustion engine of claim 10, wherein the lubrication pump is driven by a solenoid.

12. The internal combustion engine of claim 10, wherein the lubricant comprises an oil.

13. The internal combustion engine of claim 10, wherein the lubricant comprises a fuel.

14. An internal combustion engine comprising a lubrication system arranged to lubricate at least a portion of the engine with lubricant, the lubrication system having a lubricant tank, an alarm, and a lubrication solenoid that delivers the lubricant from the lubricant tank toward the portion of the engine, a sensor configured to sense an engine speed of the engine, a second sensor configured to sense an engine load of the engine, a third sensor configured to sense a lubricant level inside the lubricant tank, and a control device configured to compare a calculated lubricant level depending on outputs from the first sensor, the second sensor, and a battery voltage to an actual lubricant level output from the third sensor, the control device activating the alarm if the compared calculated lubricant level is not within a predetermined range of the actual lubricant level.

15. The internal combustion engine of claim 14, wherein the alarm is audible or visual or both audible and visual.

16. The internal combustion engine of claim 14, wherein the lubricant comprises an oil.

17. The internal combustion engine of claim 14, wherein the lubricant comprises a fuel.

18. An internal combustion engine comprising a lubrication system arranged to lubricate at least a portion of the engine with a lubricant, the lubrication system having a lubrication pump that delivers the lubricant toward the portion of the engine, and a means for controlling the lubrication pump to deliver an amount of lubricant based upon outputs from an engine speed sensor, an engine load sensor, a lubricant volume sensor, and a battery voltage, wherein the lubricant amount is maintained at at least a predetermined amount based on a lubricant amount control map when the battery voltage is below a predetermined value.

19. The internal combustion engine of claim 18, wherein the lubrication pump is a solenoid pump.

20. The internal combustion engine of claim 19, wherein a solenoid frequency of periodic lubricant pressurization is determined from the engine speed sensor, the engine load sensor, the lubricant volume sensor, and the battery voltage.

21. An internal combustion engine comprising a lubrication system arranged to lubricate at least a portion of the engine with lubricant, the lubrication system having a lubricant tank, an alarm, and a lubrication solenoid that delivers the lubricant from the lubricant tank toward the portion of the engine, and a means for comparing a calculated lubricant level depending on outputs from an engine speed sensor, an engine load sensor, and a battery voltage to an actual lubricant level output from a lubricant level sensor, the control device activating the alarm if the compared calculated lubricant level is not within a predetermined range of the actual lubricant level.

22. The internal combustion engine of claim 21, wherein the activated alarm is audible or visual or both audible and visual.

23. An internal combustion two-stroke engine comprising a lubrication system arranged to lubricate at least a portion of the engine with a lubricant, the lubrication system having a lubrication pump driven by a solenoid that delivers the lubricant toward the portion of the engine, at least one engine sensor configured to sense an engine characteristic, and a control device configured to control the lubrication pump, the control device determining an amount of lubricant that is delivered by the lubrication pump based upon outputs from the at least one engine sensor and a battery voltage to control the lubrication pump, wherein the control device maintains the lubricant amount at at least a predetermined amount based on a lubricant amount control map when the battery voltage is below a predetermined value.

24. The internal combustion two-stroke engine of claim 23, wherein the battery voltage comprises a voltage range between 10 and 16 volts.

25. The method of claim 1, wherein calculating the lubricant amount includes varying the lubricant amount with battery voltage.

26. The method of claim 8, wherein calculating the amount of lubricant required by the engine includes correlating said amount with the battery voltage.

27. The internal combustion engine of claim 10, wherein the amount of lubricant determined by the control device directly correlates to the battery voltage.

28. An internal combustion engine comprising:

a lubrication system arranged to lubricate at least a portion of the engine with a lubricant, the lubrication system having a lubrication pump that delivers the lubricant toward the portion of the engine; and a control device controlling the lubrication pump to deliver an amount of lubricant based upon outputs from an engine speed sensor, an engine load sensor, a lubricant volume sensor, and a battery voltage, wherein the lubrication pump is a solenoid pump and wherein a solenoid frequency of periodic lubricant pressurization is determined from the engine speed sensor, the engine load sensor, the lubricant volume sensor, and the battery voltage.

* * * * *

UNITED STATES PATENT AND TRADEMARK OFFICE

CERTIFICATE OF CORRECTION

PATENT NO. : 7,007,656 B2
APPLICATION NO. : 10/701904
DATED : March 7, 2006
INVENTOR(S) : Kenichi Fujino It is certified that error appears in the above-identified patent and that said Letters Patent is hereby corrected as shown below:

At column 4, line 23, please delete "EMBODIMENT" and insert -- EMBODIMENTS --, therefor.

At column 6, line 63, after "fires" please delete ",", therefor.

At column 11, line 1, please delete "$KB_v$"and insert -- $kB_v$ --, therefor.

Signed and Sealed this

Twelfth Day of December, 2006

JON W. DUDAS
*Director of the United States Patent and Trademark Office*